United States Patent [19]

Kikuchi et al.

[11] Patent Number: 4,543,884

[45] Date of Patent: Oct. 1, 1985

[54] SHUTTLE TYPE LINE PRINTER

[75] Inventors: Hiroshi Kikuchi; Kenji Sato, both of Tokyo, Japan

[73] Assignee: Oki Electric Industry Co., Ltd., Tokyo, Japan

[21] Appl. No.: 551,002

[22] Filed: Nov. 14, 1983

[30] Foreign Application Priority Data

Nov. 19, 1982 [JP] Japan ..... 57-201887

[51] Int. Cl.[4] ..... B41J 7/70

[52] U.S. Cl. ..... 101/93.04; 101/93.05; 400/124

[58] Field of Search ..... 101/93.04, 93.05, 93.15, 101/93.16, 93.09, 93.37, 93.43, 93.47, 93.48; 400/121, 124, 320, 322, 328

[56] References Cited

U.S. PATENT DOCUMENTS

| | | | |
|---|---|---|---|
| 3,941,051 | 3/1976 | Barrus et al. | 101/93.04 |
| 4,306,497 | 11/1981 | Hamada | 101/93.05 |
| 4,359,289 | 11/1982 | Barrus et al. | 101/93.04 |

*Primary Examiner*—Edgar S. Burr
*Assistant Examiner*—John A. Weresh
*Attorney, Agent, or Firm*—Peter L. Berger

[57] ABSTRACT

The present invention relates to a shuttle type line printer which is characterized in that among members constituting printing elements of the shuttle type line printer, such as a permanent magnet, an electromagnet, a yoke and a printing hammer, the permanent magnet occupying a considerable proportion of the total weight of the printing elements is separated from the shuttle to reduce the weight loaded on the shuttle, and the permanent magnet separated from the shuttle is used as a part or all of a balancer indispensable for removing lateral vibrations having fatal influences on the shuttle type line printer. In a conventional shuttle type line printer, all of printing elements such as a permanent magnet, an electromagnet, a yoke and a printing hammer are loaded on one shuttle and a balancer having a weight corresponding to a heavy total weight of the shuttle should be disposed to remove undesirable lateral vibrations. The shuttle type line printer of the present invention is advantageous over this conventional shuttle type line printer in that the permanent magnet alone or with a slight auxiliary weight is sufficient as the balancer and the weight and space required for the balancer in the conventional printer can be removed completely or partially, with the result that the size and weight of the printer as a whole can be reduced, the printing speed can be increased and the energy consumption can be decreased.

4 Claims, 4 Drawing Figures

SHUTTLE TYPE LINE PRINTER

BACKGROUND OF THE INVENTION (1.) Field of the Invention

The present invention relates to a shuttle type line printer comprising a shuttle making a reciprocating movement along the direction of the printing line, printing hammers arranged equidistantly on the shuttle and printing pins arranged on the free ends of the printing hammers to effect the printing operation.

(2.) Description of the Prior Art

In a conventional shuttle type line printer, to a rectangular shuttle making a reciprocating movement along the direction of the printing line is fixed a first yoke having a size similar to the size of the shuttle, and a rectangular permanent magnet having a length similar to that of the first yoke is secured to the upper portion of the first yoke and a second yoke having a size similar to that of the first yoke is secured to the upper portion of the permanent magnet. A plurality of projections are equidistantly formed on the second yoke on the side of printing paper, and coils are wound on the respective projections to form a plurality of electromagnets. A plurality of printing hammers are arranged equidistantly in the direction of the printing line on the first yoke on the side of printing paper so that the number of the printing hammers is equal to the number of the electromagnet and the distance between every two adjacent printing hammers is the same as the distance between every two adjacent electromagnets. Printing wires for urging these printing hammers are secured to the printing paper sides of the free ends of the respective printing hammers. Accordingly, a magnetic path defined by the permanent magnets, yokes, electromagnets and printing hammers constituting printing elements of the line printer is formed on the rectangular shuttle.

One end in the longitudinal direction of the shuttle is connected to an eccentric cam for reciprocating the shuttle along the direction of the printing line. Namely, the shuttle is reciprocated along the direction of the printing line by rotation of the eccentric cam. At this reciprocating movement, the force of inertia is generated in the longitudinal direction of the shuttle, that is, on the left side or right side of the shuttle due to the mass of the shuttle. This force of inertia is considerably large because the shuttle is formed of by a large-size permanent magnet having a large mass and yokes. Accordingly, the shuttle type line printer severely shakes from left to right. In the conventional shuttle type line printer, in order to prevent this shaking, a balancer having a mass equal to or similar to the mass of the shuttle is attached along the shuttle, and this balancer is reciprocated in the opposite direction to the direction of the reciprocating movement of the shuttle by means of an eccentric cam. If this arrangement is adopted, the force of inertia generated by the reciprocative movement of the shuttle is cancelled or reduced by the reverse force of inertia generated by the reciprocal movement of the balancer, whereby shaking of the shuttle type line printer is diminished.

Since the shuttle bears a large-size permanent magnet, yokes and the like, the weight of the shuttle is considerably heavy, and therefore, a balancer having a large size and heavy weight should be used and in some cases, the size and weight of the printing zone of the shuttle type line printer are substantially occupied by those of the shuttle and balancer. Namely, the size and weight of the printing zone are about 2 times the size and weight inherently necessary for the printing zone.

Accordingly, in the conventional shuttle type line printer, the size and weight are increased by the balancer, and therefore, it is very difficult to increase the speed of operation. Moreover, even if high speed operation is possible, since not only the shuttle but also the balancer having a mass similar to that of the shuttle should be driven, the energy consumption is increased, and a desire to provide a small -size, high-speed printer having a reduced energy consumption is not realized. Furthermore, since additional materials and parts are necessary for the balancer, the manufacturing cost is increased. It may be said that development of shuttle type line printers is inhibited by the above-mentioned defects.

SUMMARY OF THE INVENTION

The present invention relates to a shuttle type line printer which is characterized in that among members constituting printing elements of the shuttle type line printer, such as a permanent magnet, an electromagnet, a yoke and a printing hammer, the permanent magnet occupying a considerable proportion of the total weight of the printing elements is separated from the shuttle to reduce the weight loaded on the shuttle, and the permanent magnet separated from the shuttle is used as a part or all of a balancer indispensable for removing lateral vibrations having detrimental influences on the shuttle type line printer.

It is a primary object of the present invention to provide a shuttle type line printer in which a permanent magnet is separated from a shuttle and is used as a balancer, whereby the size is made much smaller than that of the conventional shuttle type line printer and the printing operation speed is increased.

Another object of the present invention is to provide a shuttle type line printer in which a permanent magnet is separated from a shuttle and is used as a balancer, whereby the weight is made much lighter than that of the conventional shuttle type line printer and the energy consumption is remarkably reduced.

Still another object of the present invention is to provide a shuttle type line printer in which a permanent magnet is separated from a shuttle and is used as a balancer, whereby the number of parts is decreased and the manufacturing cost is reduced.

More specifically, in accordance with the present invention, there is provided a shuttle type line printer, which comprises a shuttle having a plurality of printing elements loaded thereon and making a reciprocating movement along the direction of the printing line, a balancer having a mass substantially equal to the mass of the shuttle and being driven in a direction opposite to the moving direction of the shuttle, printing hammers secured to free ends of the printing elements, a permanent magnet attracting the printing hammers and electromagnets releasing the printing hammers against the magnetic force of the permanent magnet, wherein the printing hammers and electromagnets are loaded on the shuttle and a part or all of the balancer is formed by the permanent magnet.

DETAILED DESCRIPTION OF THE INVENTION

Figure 1:
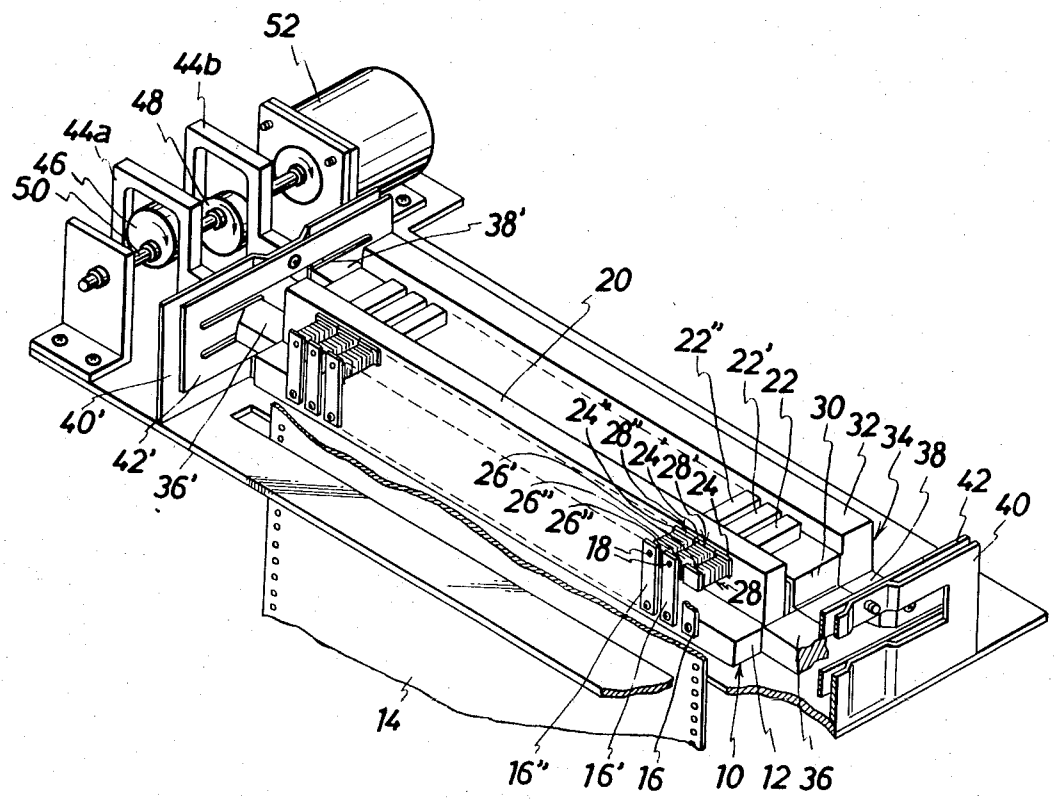
FIG. 1 is a perspective view showing a shuttle type line printer according to a first embodiment of the present invention.

FIG. 1 is a perspective view illustrating a first embodiment of the present invention. In the shuttle type line printer shown in FIG. 1, a rectangular yoke 12 making a reciprocating movement along the direction of the printing line constitutes the base of a shuttle 10. A plurality of printing hammers 16,16′ and 16″, each being composed of a plate of a magnetic material, are equidistantly arranged on the yoke 12 on the side of printing paper 14, and printing pins 18 are secured to the free ends of the printing hammers 16, 16′ and 16″ on the side of the printing paper 14. A rectangular holding plate 20 composed of a non-magnetic material, which has a length substantially equal to the length of the yoke 12, is secured to the yoke 12. Square holes are equidistantly formed on the side face of the holding plate 20 so that the number of the holes is the same as the number of the printing hammers 16, 16′ and 16″ and the distance between every two adjacent holes is same as the distance between every two adjacent printing hammers. Long electromagnets 28, 28′ and 28″ comprising cores 26, 26′ and 26″ having one end each formed into yokes 22, 22′ and 22″ and the other end wound by coils 24, 24′ and 24″ are inserted and fixed in the above-mentioned holes so that the coils 24, 24′ and 24″ are located on the side of the printing paper 14. A long permanent magnet 30 which has a length substantially equal to the length of the yoke 12 and is polarized in the vertical direction is arranged between the yoke 12 and yokes 22, 22′ and 22″ so that a small space is formed between the permanent magnet 30 and the yoke 12 and a same small space is formed between the permanent magnet 30 and the yokes 22, 22′ and 22″.

An auxiliary weight 32 composed of a non-magnetic material is secured in the rear of the permanent magnet 30. A balancer 34 is constructed by the permanent magnet 30 and the auxiliary weight 32 so that the mass of the balancer 34 is substantially equal to the mass of the shuttle 10. The permanent magnet 30 should have a size sufficient to retain a magnetic force necessary for attracting the printing hammers 16, 16′ and 16″. The mass of the permanent magnet 30 may be substantially equal to those of other members of the printing elements, that is,the electromagnets 28, 28′ and 28″ and the yoke 12. In this case, the balancer 34 may be constructed only by the permanent magnet 30.

Connecting rods 36 and 36′ and connecting rods 38 and 38′ composed of a non-magnetic material are secured to both the ends in the longitudial direction of the shuttle 10 and balancer 34, respectively, and these connecting rods 36 and 36′ and 38 and 38′ are biased by plate springs 42 and 42′ secured to side plates 40 and 40′, respectively. The shuttle 10 and balancer 34 are held by these connecting rods at the position where the biassing forces are balanced.

A long hole is formed in the side plate 40′, and eccentric cam receivers 44*a* and 44*b* abut through this hole against the plate spring 42′ on the side opposite to the connecting rods 36′ and 38′. Coaxial eccentric cams 46 and 48 are arranged in the eccentric cam receivers 44*a* and 44*b*, respectively, and one end of the shaft 50 for the eccentric cams 46 and 48 is connected to a motor 52. The eccentric cams 46 and 48 are simultaneously rotated by the motor 52.

Figure 2:
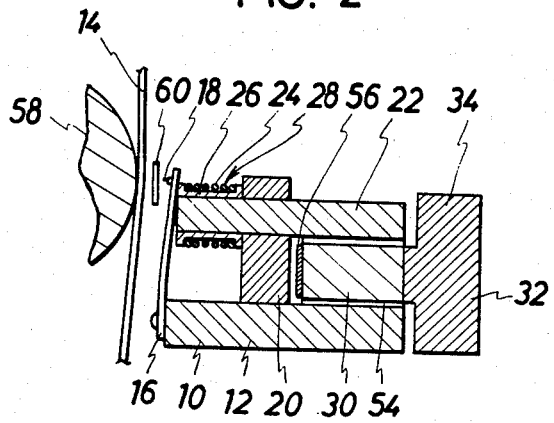
FIG. 2 is a sectional view illustrating the relation between a shuttle and a balancer in the first embodiment of the present invention.

FIG. 2 is a sectional view illustrating the relation between the shuttle comprising the electromagnets, yokes and printing hammers and the balancer comprising the permanent magnet and the auxiliary weight in the first embodiment of the present invention. The small space between the permanent magnet 30 and the yoke 12 located below and the small space between the permanent magnet 30 and the yokes 22, 22′ and 22″ located above are filled with a magnetic fluid 54.

In the above-mentioned printing elements, there is formed a closed magnetic loop starting at the permanent magnet 30, passing through the upper portion of the magnetic fluid 54, the yoke 22, the core 26, the printing hammer 16, the yoke 12 and the lower portion of the magnetic fluid 54 and returning to the permanent magnet 30. Accordingly, the printing hammer 16 is attracted to the core 26. In this case, the magnetic fluid 54 forms a part of the closed loop, and is concentrated in the small space between the permanent magnet 30 and the yoke 22 and the small space between the permanent magnet 30 and the yoke 12, where a strong magnetic field is present. However, in the case where the electromagnet 28 is energized to cancel the magnetic force of the permanent magnet 30 and release the printing hammer 16, the closed magnetic loop starting at the permanent magnet 30, passing through the upper portion of the magnetic fluid 54, the yoke 22, the core 26, the printing hammer 16, the yoke 12 and the lower portion of the magnetic fluid 54 and returning to the permanent magnet 30 is extinguished. In this case, the magnetic fluid 54 is present in a magnetic field generated around the magnetic fluid but cannot be present in the small space between the permanent magnet 30 and the yoke 22 or in the small space between the permanent magnet 30 and the yoke 12. Namely, the magnetic fluid 54 is present around the permanent magnet 30 while surrounding the magnet 30. This can be prevented by covering the side face of the permanent magnet 30 on the side of the printing paper with a damping plate 56 of a non-magnetic material having a thickness enough to prevent leakage of the magnetic flux to the space of the permanent magnet 30 to some extent. Namely, by this disposition of this damping plate 56, even if the printing hammer 16 is released, it is substantially possible to hold the magnetic fluid 54 in the space between the permanent magnet 30 and the yoke 22 and in the space between the permanent magnet 30 and the yoke 12. Incidentally, reference numerals 58 and 60 represent a platen and an ink ribbon, respectively.

The operation of the shuttle type line printer having above-mentioned structure will now be described.

Referring to FIG. 1, the motor 52 is driven to rotate the eccentric cams 46 and 48 secured to the same shaft, in which the difference of the angle of the phase of eccentricity is 180°. The rotation of the eccentric cam 46 is converted to a linear movement by the eccentric cam receiver 44*a*, which bends the plate spring 42 or 42' and reciprocates the shuttle 10 along the direction of the printing line through the connecting rod 36'.

The rotation of the eccentric cam 48 is converted to a linear movement by the eccentric cam receiver 44*b*, which bends the plate spring 42' or 42 and reciprocates the balancer 34 along the shuttle 10 in the direction reverse to the moving direction of the shuttle 10 through the connecting rod 38'.

The force of inertia generated by the above-mentioned reciprocating movement of the shuttle 10 is cancelled by the force of inertia acting in the reverse direction and having the same intensity, which is generated by the reciprocating movement of the balancer 34.

The attracting force between the permanent magnet 30 and the yoke 12 or the yokes 22, 22' and 22'' acts substantially in the vertical direction to the shuttle 10, and therefore, the resistance imposed on the reciprocal movements of the shuttle 30 and balancer 34 in the horizontal direction is very small. Furthermore, since the plate springs 42 and 42' are composed of a material sufficient to hold the shuttle 10 and balancer 34, even if the shuttle 10 and balancer 34 are reciprocated, the small spaces between the permanent magnet 30 and the yoke 12 and between the permanent magnet 30 and the yokes 22, 22' and 22'' can be maintained as they are. Although the gap between the shuttle 10 and the printing paper 14 is changed by the reciprocating movements of the shuttle 10 and balancer 34, since the stroke of the reciprocating movement of the shuttle 10 is small, the resulting change of the gap is small. Furthermore, the printing force by the printing hammers 16, 16' and 16'' is large. Accordingly, it is considered that the printing operation in the shuttle type line printer of the present invention is hardly influenced by the above-mentioned change of the gap. Similarly, the gap between the shuttle 10 and the balancer 34 is changed, but this problem can be solved by adjusting this gap so that no conflict is caused between the shuttle 10 and balancer 34 at the reciprocal movements thereof. Furthermore, at the reciprocal movements of the shuttle 10 and balancer 34, the magnetic fluid 54 is retained in the above-mentioned spaces without scattering.

Accordingly, the magnetic circuit in the shuttle type line printer of the present invention is substantially equivalent to that of the conventional shuttle type line printer. In the state where the coil 24 is not energized, the magnetic fluxes from the permanent magnet 30 form a closed loop starting at the permanent magnet 30, passing through the magnetic fluid 54, the yoke 22, the core 26, the printing hammer 16, the yoke 12 and the magnetic fluid 54 and returning to the permanent magnet 30, and by this closed magnetic loop, the printing hammer 16 is attracted to the core 26 and is deformed. When the coil 24 is energized, magnetic fluxes cancelling the magnetic fluxes from the permanent magnet 30 are produced in the core 26 and the attracting force acting between the printing hammer 16 and the core 26 is extinguished. Accordingly, the original linear shape is restored in the printing hammer 16 and the hammer 16 16 is deformed toward the side of the platen 58, and during this process, the printing pin 18 hits the printing paper 14 through the ink ribbon 60 and the ink on the ink ribbon 60 is transferred onto the printing paper 14 to print a dot thereon.

As is apparent from the foregoing description, in the first embodiment of the present invention, among the members constituting the printing element of the shuttle type line printer, such as the permanent magnet, electromagnet, yoke and printing hammer, the permanent magnet 30 occupying a large proportion of the weight of the printing element is separated from the shuttle 10, whereby the weight loaded on the shuttle 10 is greatly reduced. Furthermore, since the permanent magnet 30 separated from the shuttle 10 is used as a part or all of the balancer indispensable for removing lateral vibrations having negative influences on the shuttle type line printer, it becomes unnecessary to dispose a balancer having a heavy weight corresponding to the total weight of the shuttle of the conventional printer on which all of the permanent magnet, electromagnet, yoke and printing hammer as the printing element are loaded. In this point, the shuttle type line printer of the present invention is advantageous over the conventional shuttle type line printer, because the permanent magnet alone or in combination with a small auxiliary weight acts as the balancer sufficiently.

In the conventional shuttle type line printer, the majority of the weight of the printing zone is occupied by the weight of the shuttle and the balancer. On the other hand, if the permanent magnet is separated from the shuttle and used as the balancer in the above-mentioned manner according to the present invention, the size and weight of the shuttle as a whole can be substantially halved. That is, the size and weight of the printing zone can be halved. Accordingly, the size of the shuttle type line printer can be reduced by the space occupied by the balancer in the conventional printer, and the weight of the permanent magnet occupying the large proportion of the printing element in the conventional printer is subtracted from the total weight of the shuttle having the printing elements loaded thereon. Therefore, it becomes possible to reciprocate the shuttle at an increased speed. Moreover, since the weight of the shuttle is reduced, the energy consumption can be reduced, and since the balancer used in the conventional printer is replaced by the permanent magnet separated from the shuttle, the manufacturing cost can be reduced. Thus, various advantages can be attained according to the present invention.

In the above-mentioned first embodiment of the present invention, from the shuttle having loaded thereon the permanent magnet, electromagnet, yoke and printing hammer, the permanent magnet is separated and this permanent magnet is used as a part or all of the balancer, whereby the force of inertia generated by the reciprocating movement of the shuttle is cancelled by the force of inertia acting in the reverse direction, which is generated by the balancer comprising the permanent magnet. Namely, by causing the permanent magnet to act as the conventional balancer, the size and weight of the shuttle type line printer can be diminished while the force of inertia generated by the shuttle is cancelled by the force of inertia generated by the permanent magnet as the balancer.

Figure 3:
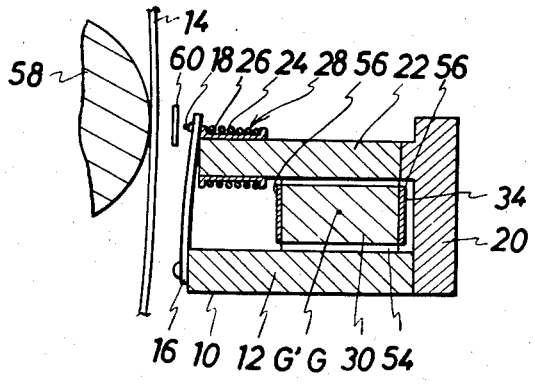
FIG. 3 is a sectional view illustrating the relation between a shuttle and a balancer in a second embodiment of the present invention.

FIG. 3 is a sectional view illustrating the relation between a shuttle having loaded thereon an electromagnet, a yoke and a printing hammer and a balancer comprising a permanent magnet in a second embodiment of the present invention. This embodiment is in agreement with the first embodiment in the point where the permanent magnet 30 is separated from the shuttle 10. However, this embodiment is different from the first embodiment in the point where the holding plate 20 is arranged in the rear of the permanent magnet 30 and the centroid G' in the cross-section of the separated permanent magnet 30 is made in agreement with the centroid G in the section of the shuttle 10 from which the permanent magnet 30 has been separated. If this arrangement is adopted, also the couple of force to rotate the shuttle type line printer, which is generated by the forces of inertia of the shuttle 10 and balancer 34 when the shuttle 10 and balancer 34 are reciprocated in the first embodiment, can be removed. Also in this embodiment, the reciprocating movements of the shuttle and balancer 34 may be accomplished by the motor 52 and the eccentric cams 46 and 48 as shown in FIG. 1.

In the above-mentioned first embodiment, the motor 52 and the eccentric cams 46 and 48 are used as means for reciprocating the shuttle 10 and balancer 34. Of course, however, other reciprocting mechanisms may be adopted. In the first embodiment, the plate spring having the printing pin fixed to the free end thereof is used as the printing hammer. Of course, there may be adopted a printing hammer composed of a plate material having a high rigidity. In this case, this printing hammer is released to hit the printing wire.

In the first and second embodiments described above, there is adopted a spring charge type printing element in which the printing hammer 16 is attracted by the magnetic force of the permanent magnet, the electromagnet 28 is energized at the time of printing to generate a reverse magnetic force cancelling the magnetic force of the permanent magnet 30 and the printing hammer 16 is thus released to convert the distortion energy of the printing hammer 16 to a printing energy. Of course, a printing element other than this spring change type printing element, for example, a printing element as shown in FIG. 4, may be adopted.

Figure 4:
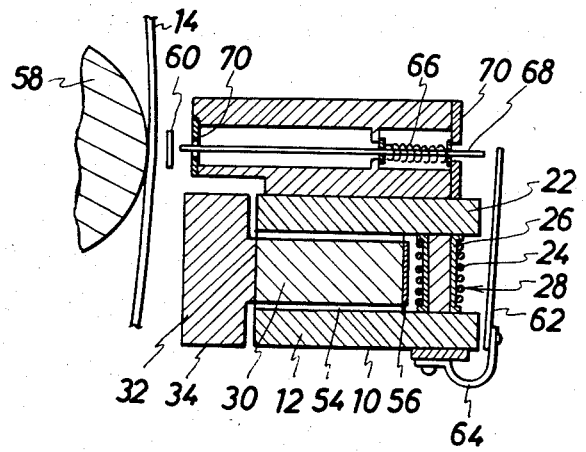
FIG. 4 is a sectional view illustrating the relation between a shuttle and a balancer in a third embodiment of the present invention.

FIG. 4 illustrates a third embodiment of the present invention. In this embodiment, a closed magnetic loop starting at the permanent magnet 30, passing through the upper portion of the magnetic fluid 54, the yoke 22, the core 26, the yoke 12 and the lower portion of the magnetic fluid 54 and returning to the permanent magnet 30 is formed. At the time of printing, the coil 24 of the electro magnet 28 is energized to generate a magnetic force acting in a direction cancelling the magnetic force of the permanent magnet which passes through the core 26. Accordingly, the magnetic loop formed by the permanent magnet 30 is changed to a closed loop starting at the permanent magnet 30, passing through the upper portion of the magnetic fluid 54 and the yoke 22, joining with the magnetic loop generated by the electromagnet 28, passing through the printing hammer 62, the yoke 12 and the lower portion of the magnetic fluid 54 and returning to the permanent magnet 30. On the other hand, the magnetic loop generated by the electromagnet 28 starts at the electromagnet 28, passes through the yoke 22, the printing hammer 62 and the yoke 12 and returns to the electromagnet 28. Accordingly, the printing hammer 62 is attracted to the yokes 22 and 12 against the biasing forces of a reset plate spring 64 and a reset spring 66 to hit a printing wire 68. Incidentally, reference numeral 70 in FIG. 4 represents a guide for the printing wire 68.

In each of the foregoing first, second and third embodiments, the small space between the permanent magnet 30 and the yoke 12 and the small space between the permanent magnet 30 and the yoke 22 are filled with a magnetic fluid so as to reduce the magnetic resistance, with the result that the magnetic resistance on the magnetic loop generated by the permanent magnet 30 is reduced. Even if the magnetic fluid is removed and air gaps are formed instead of the above-mentioned small spaces, the printing operation is performed in the same manner though the magnetic resistance is increased to some extent. In the foregoing embodiments shown in FIGS. 1, 2, 3 and 4, the yokes 22, 22′ and 22″ are separated from one another. However, if the core 26, 26′ or 26″ and the coil 24, 24′ or 24″ of the electromagnet 28 are independently formed by a plurality of cores and a plurality of coils, these yokes 22, 22′ and 22″ may be intergrated into one yoke.

As is apparant from the foregoing description, according to the present invention, the permanent magnet occupying considerable proportions of the size and weight of the printing element constituting the shuttle of the shuttle type line printer is separated from the shuttle and is used as a balancer. Accordingly, the size and weight of the line printer can be diminished, and a small desk shuttle type line printer having a small size and light weight can conveniently be provided according to the present invention. Furthermore, the weight of the shuttle per se can be reduced. Accordingly, the printing operation speed can be increased and the energy consumption can be reduced. Moreover, since the quantity of the material to be used for construction can be reduced as compared with the material used in the conventional shuttle type line printer, the manufacturing cost can be lowered. In short, a line printer characterized by a small size, a light weight, a high printing speed, a small energy consumption and a low cost can advantageously be provided according to the present invention.

What is claimed is:

1. A shuttle type line printer which comprises a shuttle having a plurality of printing elements loaded thereon and making a reciprocating movement along the direction of the printing line, a balancer separate from the shuttle and having a mass subsequently equal to the mass of the shuttle and being driven in a direction opposite to the moving direction of the shuttle, printing hammers secured to free ends of the printing elements, a permanent magnet attracting the printing hammers and electromagnets releasing the printing hammers against the magnetic forces of the permanent magnets, wherein the printing hammers and electromagnets are loaded on the shuttle and said separate balancer comprises the permanent magnet, wherein yokes are arranged above and below the permanent magnet with small spaces being interposed therebetween, and said yokes are connected together to construct a part of the shuttle, and one end of each printing hammer is secured to one end of one of the yokes and a printing pin is projected on the other end of each printing hammer towards paper to be printed on.

2. A shuttle type line printer which comprises a shuttle having a plurality elements loaded thereon and making a reciprocating movement along the direction of the printing line, a balancer separate from the shuttle and having a mass substantially equal to the mass of the shuttle and being driven in a direction opposite to the moving direction of the shuttle, printing hammers secured to free ends of the printing elements, a permanent magnet attracting the printing hammers and electromagnets releasing the printing hammers against the magnetic forces of the permanent magnets, wherein the printing hammers and electromagnets are loaded on the shuttle and said separate balancer comprises the permanent magnet, wherein yokes arranged above and below the permanent magnet with small spaces being interposed therebetween, and said yokes are connected together to construct a part of the shuttle, said yokes projecting from the permanent magnet, a core being laid out between the projected yokes and a coil being wound on the core to form an electromagnet, and a printing hammer being attached to one yoke through a plate spring and a printing wire being urged toward the printing hammer by a reset spring located in front of the top portion of the printing hammer between the printing hammer and paper to be printed on.

3. A shuttle type line printer as set forth in claim 1, wherein the permanent magnet comprising the balancer has a cross-sectional centroid and the shuttle exclusive of the permanent magnet has a cross-sectional centroid, and wherein both cross-sectional centroids are located at a common point.

4. A shuttle type line printer as set forth in claim 2, wherein the permanent magnet comprising the balancer has a cross-sectional centroid and the shuttle exclusive of the permanent magnet has a cross-sectional centroid, and wherein both cross-sectional centroids are located at a common point.

* * * * *